US008446402B2

(12) United States Patent
Sang et al.

(10) Patent No.: US 8,446,402 B2
(45) Date of Patent: May 21, 2013

(54) LIQUID CRYSTAL DISPLAY

(75) Inventors: Wookyu Sang, Joong-ri (KR); Juyoung Lee, Gumi-si (KR); Yunsung Yang, Daegu (KR)

(73) Assignee: LG Display Co. Ltd., Seoul (KR)

( * ) Notice: Subject to any disclaimer, the term of this patent is extended or adjusted under 35 U.S.C. 154(b) by 873 days.

(21) Appl. No.: 12/579,727

(22) Filed: Oct. 15, 2009

(65) Prior Publication Data

US 2010/0283777 A1 Nov. 11, 2010

(30) Foreign Application Priority Data

May 11, 2009 (KR) ..... 10-2009-0040715

(51) Int. Cl.
*G09G 3/36* (2006.01)

(52) U.S. Cl.
USPC ..... 345/212; 345/87; 345/208; 345/204; 345/99; 345/94

(58) Field of Classification Search
USPC ..... 345/94–95, 87, 99, 204, 208, 212
See application file for complete search history.

(56) References Cited

U.S. PATENT DOCUMENTS

2008/0106535 A1* 5/2008 Kim et al. ..... 345/205

FOREIGN PATENT DOCUMENTS

| | | | |
|---|---|---|---|
| CN | 101183831 | A | 5/2008 |
| CN | 101266762 | A | 9/2008 |
| KR | 20070091244 | A | 9/2007 |

OTHER PUBLICATIONS

Office Action issued in corresponding Korean Patent Application No. 10-2009-0040715, mailed Nov. 7, 2012.

* cited by examiner

*Primary Examiner* — Amare Mengistu
*Assistant Examiner* — Shawna Stepp Jones
(74) *Attorney, Agent, or Firm* — Brinks Hofer Gilson & Lione

(57) ABSTRACT

A liquid crystal display is disclosed. The liquid crystal display includes a liquid crystal display panel on which a plurality of data lines and a plurality of gate lines are positioned to cross one another and a plurality of liquid crystal cells driven according to a voltage difference between a data voltage and a common voltage are positioned in a matrix format, a side printed circuit board (PCB) connected to the side of the liquid crystal display panel, and a DC to DC converter that is mounted on the side PCB to produce a driving voltage of the liquid crystal display panel.

10 Claims, 17 Drawing Sheets

LIQUID CRYSTAL DISPLAY

This application claims the benefit of Korea Patent Application No. 10-2009-0040715 filed on May 11, 2009, the entire contents of which is incorporated herein by reference for all purposes as if fully set forth herein.

BACKGROUND

1. Field of the Invention

Embodiments of the disclosure relate to a liquid crystal display.

2. Discussion of the Related Art

Active matrix type liquid crystal displays display a moving picture using a thin film transistor (TFT) as a switching element. Active matrix type liquid crystal displays have been implemented in televisions as well as display devices in portable devices, such as office equipment and computers, because of the thin profile of an active matrix type liquid crystal displays. Accordingly, cathode ray tubes (CRT) are being rapidly replaced by active matrix type liquid crystal displays.

A liquid crystal display generally includes a liquid crystal display panel, a backlight unit providing light to the liquid crystal display panel, a data drive circuit supplying a data voltage to data lines of the liquid crystal display panel, a source printed circuit board (PCB) connected to the data drive circuit, a gate drive circuit supplying a gate pulse (i.e., a scan pulse) to gate lines (i.e., scan lines) of the liquid crystal display panel, a control circuit controlling the data drive circuit and the gate drive circuit, a DC to DC converter generating driving voltages of the liquid crystal display panel and voltages required to drive the data drive circuit, the gate drive circuit, and the control circuit, a control PCB on which the control circuit and the DC to DC converter are mounted, and the like. The source PCB is connected to the side of the liquid crystal display panel. In the related art liquid crystal display, because a large number of circuit parts, such as a memory and an interface circuit, as well as the control circuit and the DC to DC converter are mounted on the control PCB, it is difficult to reduce the size of the control PCB. Accordingly, it is difficult to achieve the thin profile of the related art liquid crystal display because of the control PCB.

BRIEF SUMMARY

In one aspect of the disclosure, a liquid crystal display comprises a liquid crystal display panel on which a plurality of data lines and a plurality of gate lines are positioned to cross one another and a plurality of liquid crystal cells driven according to a voltage difference between a data voltage and a common voltage are positioned in a matrix format, a side printed circuit board (PCB) connected to the side of the liquid crystal display panel, a DC to DC converter that is mounted on the side PCB to produce a driving voltage of the liquid crystal display panel, a data drive circuit that is connected between the side PCB and the data lines of the liquid crystal display panel to convert digital video data into the data voltage using a gamma reference voltage and to supply the data voltage to the data lines, a gate drive circuit that is connected to the gate lines of the liquid crystal display panel to sequentially supply a gate pulse swinging between a gate high voltage and a gate low voltage to the gate lines, and a timing controller that supplies the digital video data to the data drive circuit and controls an operating timing of the data drive circuit and an operating timing of the gate drive circuit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Figure 1:
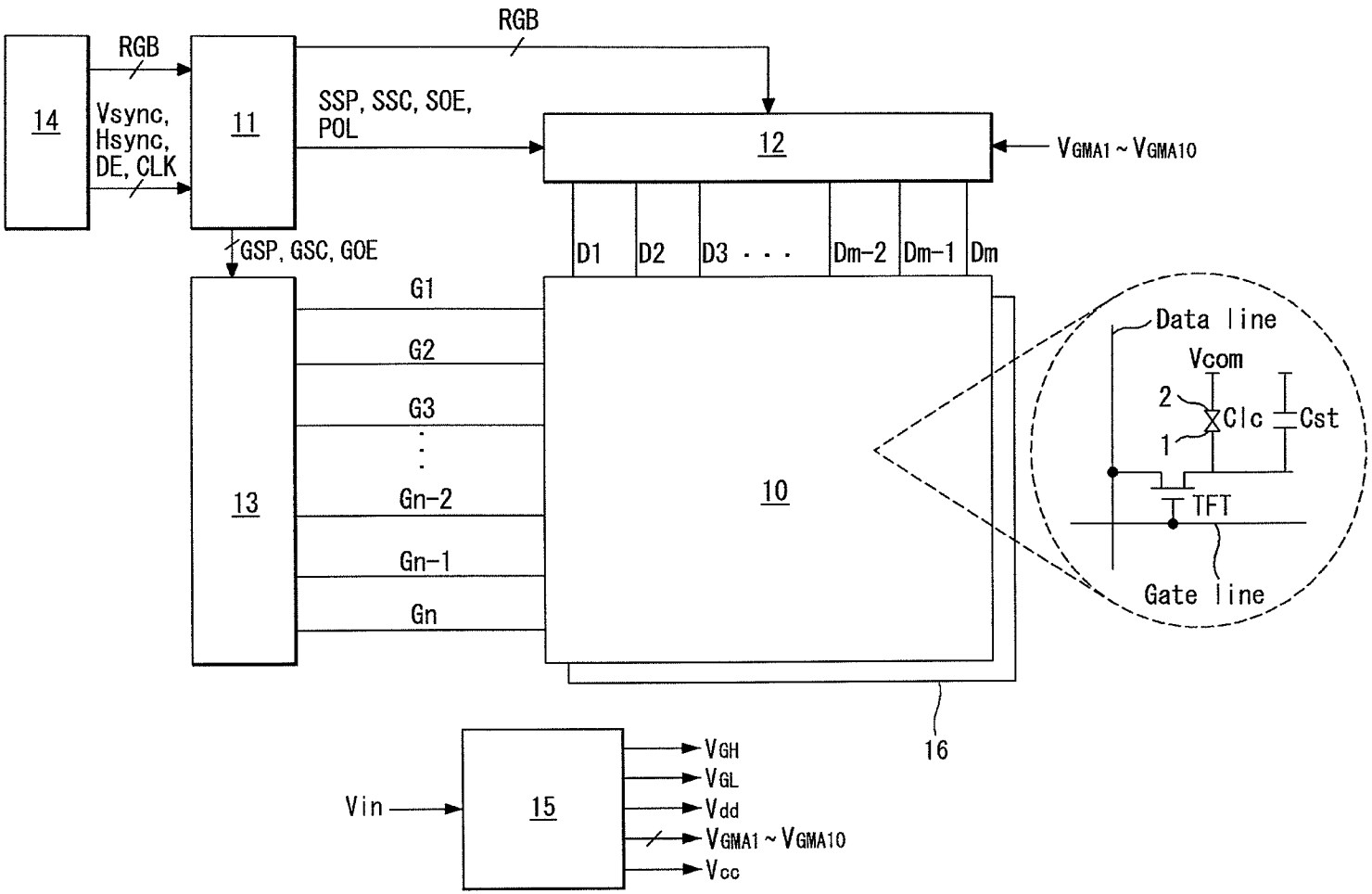
FIG. 1 is a block diagram of a liquid crystal display according to an embodiment of the invention.

A method of manufacturing a liquid crystal display according to an embodiment of the invention includes a process for cleansing substrates of a liquid crystal display panel, a process for patterning the substrates, a process for forming and rubbing alignment layers, a process for sealing the substrates and dropping liquid crystals, a process for mounting driving circuits, a module assembly process, and the like.

The substrate cleansing process is a process for removing polluted materials from the surfaces of upper and lower glass substrates of the liquid crystal display panel using a cleansing solution. The substrate patterning process includes a process for forming and patterning various thin film materials, such as signal lines including data lines and gate lines, thin film transistors (TFTs), and pixel electrodes, on the lower glass substrate and a process for forming and patterning various thin film materials, such as a black matrix, a color filter, and a common electrode, on the upper glass substrate. In the process for forming and rubbing the alignment layers, alignment layers are respectively coated on the upper and lower glass substrates, and then are rubbed using a rubbing cloth or are photo-alignment processed. After the above-described processes are performed, a pixel array is formed on the lower glass substrate of the liquid crystal display panel. The pixel array includes data lines receiving a video data voltage, gate lines that cross the data lines and sequentially receive a scan signal (i.e., a gate pulse), TFTs formed at each of crossings of the data lines and the gate lines, pixel electrodes of liquid crystal cells respectively connected to the TFTs, a storage capacitor, and the like. A shift register of a gate drive circuit generating the scan signal may be formed at the same time as the pixel array during the substrate patterning process. A black matrix, a color filter, and a common electrode are formed on the upper glass substrate of the liquid crystal display panel. The common electrode is formed on the upper glass substrate in a vertical electric field driving manner, such as a twisted nematic (TN) mode and a vertical alignment (VA) mode. The common electrode and the pixel electrode are formed on the lower glass substrate in a horizontal electric field driving manner, such as an in-plane switching (IPS) mode and a fringe field switching (FFS) mode. Polarizing plates are attached respectively to the upper and lower glass substrates, and protective films are attached respectively to the polarizing plates.

In the process for sealing the substrates and dropping the liquid crystals, in a vacuum chamber, a sealant is drawn on one of the upper and lower glass substrates, and the liquid crystals are dropped onto the other glass substrate. Supposing that the liquid crystals are dropped onto the lower glass substrate, an ultraviolet curable sealant is formed on the upper glass substrate in the vacuum chamber. The upper glass substrate on which the ultraviolet curable sealant is formed is reversed and is fixed on an upper stage, and the lower glass substrate onto which the liquid crystals are dropped is fixed on a lower stage. Hence, the upper and lower glass substrates are aligned. Subsequently, a pressure is applied to one of the upper and lower glass substrates in a state where a pressure of the vacuum chamber is adjusted to a predetermined vacuum pressure by driving a vacuum pump to seal the upper and lower glass substrates to each other. In this case, a cell gap of a liquid crystal layer between the upper and lower glass substrates is set at a greater value than a cell gap set in the design. Subsequently, nitrogen ($N_2$) is injected into the vacuum chamber to adjust the pressure of the vacuum chamber to an atmospheric pressure. Hence, the cell gap of the liquid crystal layer is set at the cell gap set in the design because of a difference between a pressure inside the sealed glass substrates and the pressure of the vacuum chamber. In the state where the cell gap is set at the design value, ultraviolet rays from an ultraviolet light source are irradiated onto the ultraviolet curable sealant through the upper glass substrate or the lower glass substrate to cure the ultraviolet curable sealant.

In the process for mounting the driving circuits, source driver integrated circuits (ICs) of a data drive circuit are mounted on the lower glass substrate of the liquid crystal display panel and are connected to a source printed circuit board (PCB) through a chip on glass (COG) process or a tape automated bonding (TAB) process. The gate drive circuit may be directly formed on the lower glass substrate and may be connected to the gate lines of the lower glass substrate through a Gate In Panel (GIP) process at the same time as the forming of the pixel array. Otherwise, the gate drive circuit may be attached to the lower glass substrate and may be connected to the gate lines of the lower glass substrate through the TAB process. In the process for mounting the driving circuits, the source PCB is connected to a control PCB or a system board using a flexible circuit board, such as a flexible printed circuit board (FPCB) and a flexible flat cable (FFC).

In the module assembly process, a backlight unit and the liquid crystal display panel are assembled into a liquid crystal module using a case member, such as a support main, a bottom cover, and a top case.

The method of manufacturing the liquid crystal display according to the embodiment of the invention may further include an inspection process and a repair process.

The inspection process includes an inspection of the ICs, an inspection of the signal lines, such as the data lines and the gate lines, on the lower glass substrate, an electrical inspection for detecting whether the TFTs and the pixel electrodes are defective, an electrical inspection conducted after the process for sealing the substrates and dropping the liquid crystals is performed, an lighting inspection for detecting whether the liquid crystal module is defective by turning on the backlight unit of the liquid crystal module, and the like. The repair process is performed on the defective signal lines and the defective TFTs that are determined as a repairable defective through the inspection process.

Reference will now be made in detail embodiments of the invention examples of which are illustrated in FIGS. 1 to 17.

Figure 2:
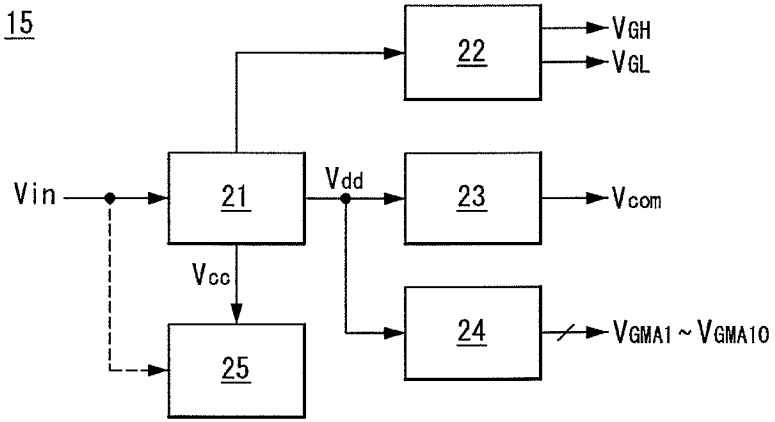
FIG. 2 is a block diagram of a DC to DC converter.

As shown in FIGS. 1 and 2, a liquid crystal display according to an embodiment of the invention includes a liquid crystal display panel 10, a backlight unit 16 underlying the liquid crystal display panel 10, a data drive circuit 12 connected to data lines D1 to Dm of the liquid crystal display panel 10, a gate drive circuit 13 connected to gate lines G1 to Gn of the liquid crystal display panel 10, a timing controller 11 for controlling the data drive circuit 12 and the gate drive circuit 13, and a DC to DC converter 15 generating a driving voltage of the liquid crystal display panel 10.

The liquid crystal display panel 10 includes an upper glass substrate and a lower glass substrate that are positioned opposite each other with a liquid crystal layer interposed between the upper glass substrate and the lower glass substrate. The liquid crystal display panel 10 includes a pixel array displaying video data. The pixel array of the lower glass substrate includes a TFT formed at each of crossings of the data lines D1 to Dm and the gate lines G1 to Gn and pixel electrodes 1 connected to the TFTs. The liquid crystal display panel 10 displays an image of the video data through a control of a transmitted amount of light provided by the backlight unit 16 by driving each of liquid crystal cells Clc of the pixel array by a difference between a data voltage applied to the pixel electrodes 1 through the TFTs and a common voltage Vcom applied to a common electrode 2 through the TFT.

A black matrix, a color filter, and the common electrode 2 are formed on the upper glass substrate of the liquid crystal display panel 10. The common electrode 2 is formed on the upper glass substrate in a vertical electric field driving manner, such as a TN mode and a VA mode. The common electrode 2 and the pixel electrode 1 are formed on the lower glass substrate in a horizontal electric field driving manner, such as an IPS mode and a FFS mode.

Polarizing plates are respectively attached to the upper and lower glass substrates of the liquid crystal display panel 10. Alignment layers for setting a pre-tilt angle of liquid crystals are respectively formed on the upper and lower glass substrates.

The liquid crystal display panel 10 applicable to the embodiment of the invention may be implemented in any liquid crystal mode as well as the TN, VA, IPS, and FFS modes. The liquid crystal display according to the embodiment of the invention may be implemented in any type liquid crystal display including a backlit liquid crystal display, a transflective liquid crystal display, and a reflective liquid crystal display. A backlight unit is necessary in the backlit liquid crystal display and the transflective liquid crystal display. The backlight unit may be implemented as a direct type backlight unit or an edge type backlight unit. The direct type backlight unit may have a structure illustrated in FIGS. 15 and 16. For example, a plurality of optical sheets 156 (166) and a diffusion plate 157 (167) are stacked under the liquid crystal display panel 10, and a plurality of light sources are positioned under the diffusion plate 157 (167). The edge type backlight unit may have a structure illustrated in FIG. 17. For example, a plurality of light sources 174 are positioned opposite the side of a light guide plate 177, and a plurality of optical sheets are positioned between the liquid crystal display panel 10 and the light guide plate 177. The light source of the backlight unit may use one or at least two of a hot cathode fluorescent lamp (HCFL), a cold cathode fluorescent lamp (CCFL), an external electrode fluorescent lamp (EEFL), and a light emitting diode (LED).

The data drive circuit 12 includes a plurality of source driver ICs. Each of the source driver ICs samples and latches R, G, and B digital video data input from the timing controller 11 in response to a data control signal received from the timing controller 11 to convert the R, G, and B digital video data into parallel data. Each of the source driver ICs converts the deserialized R, G, and B digital video data into an analog gamma compensation voltage using positive or negative gamma reference voltages VGMA1 to VGMA10 from the DC to DC converter 15 to generate a positive or negative analog video data voltage to which the liquid crystal cells will be charged. While each of the source driver ICs inverts a polarity of the positive/negative analog video data voltage in response to a polarity control signal, each of the source driver ICs supplies the positive/negative analog video data voltage to the data lines D1 to Dm. The source driver ICs are connected to the data lines D1 to Dm through a COG process or a TAB process and are connected to a source PCB.

The gate drive circuit 13 includes a plurality of gate driver ICs. Each of the gate driver ICs includes a shift register sequentially shifting a gate driving voltage in response to a gate control signal from the timing controller 11 to sequentially supply a gate pulse (i.e., a scan pulse) to the gate lines G1 to Gn. The gate drive circuit 13 may be connected to the gate lines G1 to Gn of the lower glass substrate through the TAB process or may be directly formed on the lower glass substrate through a GIP process.

The timing controller 11 receives the R, G, and B digital video data and timing signals, such as a vertical sync signal Vsync, a horizontal sync signal Hsync, a data enable signal DE, and a dot clock CLK, from a system board 14 through an interface receiving circuit, such as a low voltage differential signaling (LVDS) interface and a transition minimized differential signaling (TMDS) interface. The timing controller 11 transfers the R, G, and B digital video data to each of the source driver ICs of the data drive circuit 12 in a mini LVDS interface manner. The timing controller 11 generates a data control signal for controlling operation timing of the source driver ICs and a gate control signal for controlling operation timing of the gate driver ICs using the timing signals Vsync, Hsync, DE, and CLK. The timing controller 11 may multiply a frequency of each of the data control signal and the gate control signal based on a frame frequency of (60×i) Hz (where "i" is a positive integer), so that digital video data input at a frame frequency of 60 Hz can be reproduced in the pixel array of the liquid crystal display panel 10 at the frame frequency of (60×i) Hz.

The data control signal includes a source start pulse SSP, a source sampling clock SSC, a source output enable signal SOE, a polarity control signal POL, and the like. The source start pulse SSP controls a start time point of a data sampling operation of the data drive circuit 12. If a signal transfer manner between the timing controller 11 and the data drive circuit 12 is the mini LVDS interface, the source start pulse SSP may be omitted. The source sampling clock SSC controls a data sampling operation inside the data drive circuit 12 based on a rising or falling edge. The polarity control signal POL inverts a polarity of the data voltage output from the data drive circuit 12 every N horizontal periods, where N is a positive integer. The source output enable signal SOE controls output timing of the data drive circuit 12. When a polarity of the data voltage supplied to the data lines D1 to Dm is inverted, each of the source driver ICs supplies a charge share voltage or the common voltage Vcom to the data lines D1 to Dm in response to a pulse of the source output enable signal SOE and supplies the data voltage to the data lines D1 to Dm during a low logic period of the source output enable signal SOE. The charge share voltage is an average voltage of the neighboring data lines to which the data voltages with opposite polarities are supplied.

The gate control signal includes a gate start pulse GSP, a gate shift clock GSC, a gate output enable signal GOE, and the like. The gate start pulse GSP controls timing of a first gate pulse. The gate shift clock GSC is a clock for shifting the gate start pulse GSP. The gate output enable signal GOE controls output timing of the gate drive circuit 13.

The system board 14 transfers the timing signals, such as the vertical sync signal Vsync, the horizontal sync signal Hsync, the data enable signal DE, and the dot clock CLK, together with the R, G, and B digital video data received from a broadcast receiving circuit or an external video source to the timing controller 11 through a LVDS interface transmitting circuit or a TMDS interface transmitting circuit. The system board 14 includes a graphic processing circuit such as a scaler, and a power circuit. The graphic processing circuit interpolates a resolution of the R, G, and B digital video data in conformity with a resolution of the liquid crystal display panel 10 and performs a signal interpolation processing on the R, G, and B digital video data. The power circuit produces a voltage Vin to be input to the DC to DC converter 15.

The DC to DC converter 15 adjusts the input voltage Vin received from the power circuit of the system board 14 to generate a driving voltage of the liquid crystal display panel 10. The input voltage Vin of the DC to DC converter 15 may vary depending on the liquid crystal mode. For example, if the TN mode liquid crystal display panel 10 is used, the voltage Vin of 5V is generated. If the IPS mode liquid crystal display panel 10 is used, the voltage Vin of 12V is generated.

The DC to DC converter 15, as shown in FIG. 2, includes first to fifth voltage adjusting circuits 21 to 25.

The first voltage adjusting circuit 21 includes a pulse width modulation (PWM) IC including a PWM circuit, a boost converter, and a regulator. The first voltage adjusting circuit 21 receives the input voltage Vin to generate a high potential power supply voltage Vdd of 15V-20V and a logic power supply voltage Vcc of about 3.3V. The high potential power supply voltage Vdd is a maximum data voltage to which the liquid crystal cells Clc of the liquid crystal display panel 10 will be charged. The logic power supply voltage Vcc is a voltage required to drive the timing controller 11, the source driver ICs of the data drive circuit 12, and the gate driver ICs of the gate drive circuit 13.

The second voltage adjusting circuit 22 adjusts the high potential power supply voltage Vdd from the first voltage adjusting circuit 21 to a gate high voltage VGH equal to or greater than 15V and a gate low voltage VGL equal to or less than −3V using a charge pump. The gate high voltage VGH is a high logic level voltage of a gate pulse that is set to a value equal to or greater than a threshold voltage of the TFTs of the pixel array. The gate low voltage VGL is a low logic level voltage of a gate pulse that is set to a value less than the threshold voltage of the TFTs of the pixel array. The gate high voltage VGH and the gate low voltage VGL are supplied to the gate drive circuit 13.

The third voltage adjusting circuit 23 receives the high potential power supply voltage Vdd from the first voltage adjusting circuit 21 to generate the common voltage Vcom of 7V-8V using a regulator, a voltage division circuit, and an operation amplifier. The common voltage Vcom is supplied to the common electrode 2 of the liquid crystal cells Clc. The source driver ICs may supply the common voltage Vcom as a charge share voltage to the data lines D1 to Dm during a high logic period of the source output enable signal SOE. In a storage on common manner, a storage electrode of a storage capacitor Cst may be formed on the lower glass substrate of the liquid crystal display panel 10, so that the storage electrode overlaps the pixel electrode 1 with an insulating layer interposed between the storage electrode and the pixel electrode 1. In the storage on common manner, the common voltage Vcom may be supplied to the storage electrode.

The fourth voltage adjusting circuit 24 divides the high potential power supply voltage Vdd from the first voltage adjusting circuit 21 using a voltage division circuit to generate the positive or negative gamma reference voltages VGMA1 to VGMA10. Each of the source driver ICs converts the R, G, and B digital video data into a positive or negative analog video data voltage, to which the liquid crystal cells Clc will be charged, using the positive or negative gamma reference voltages VGMA1 to VGMA10.

The fifth voltage adjusting circuit 25 converts the logic power supply voltage Vcc from the first voltage adjusting circuit 21 in an IPS mode or the input voltage Vin of the DC to DC converter 15 in a TN mode into a core power voltage of 1.2V-1.8V using a regulator to supply the core power voltage to the timing controller 11. The core power voltage is a logic voltage for generating a mini LVDS data voltage.

In the embodiment of the invention, as shown in FIGS. 3 to 14, the size of the control PCB can reduced as compared with the related art by mounting at least a portion of circuit configurations constituting the DC to DC converter 15 mounted on an existing control PCB or all of the circuit configurations of the DC to DC converter 15 on the source PCB having a relatively enough mounting space. For example, only the first voltage adjusting circuit 21 of the DC to DC converter 15 may be mounted on the source PCB, or at least two of the first to fifth voltage adjusting circuits 21 to 25 of the DC to DC converter 15 may be mounted on the source PCB. Furthermore, in the embodiment of the invention, the size of an integral body formed by the system board 14 and the control PCB can be reduced by mounting a partial circuit configuration of the DC to DC converter 15 or all the circuit configurations of the DC to DC converter 15 on the source PCB. A connection manner between the system board 14 and the control PCB or a connection manner between the system board 14 and the source PCB may variously designed.

Figure 3:
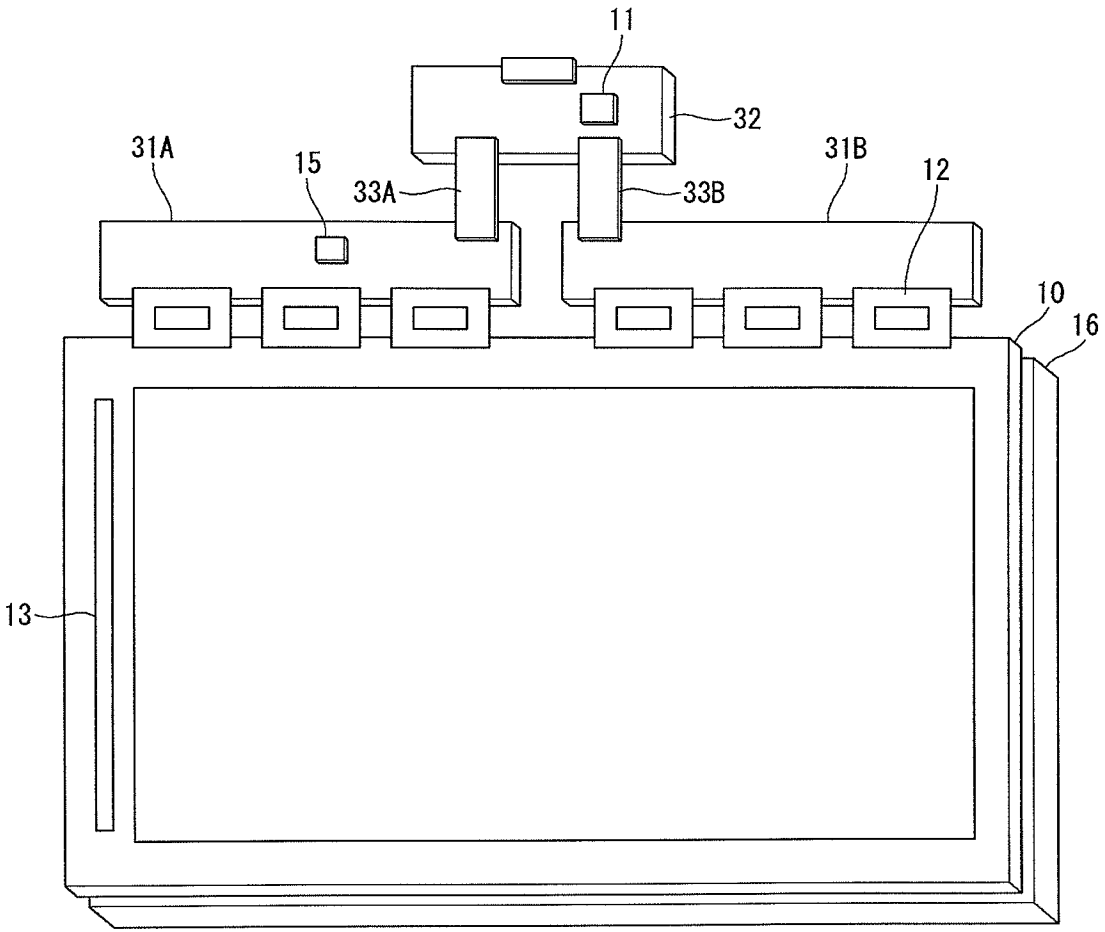
FIG. 3 is a front perspective view of a liquid crystal module according to a first embodiment of the invention.
Figure 4:
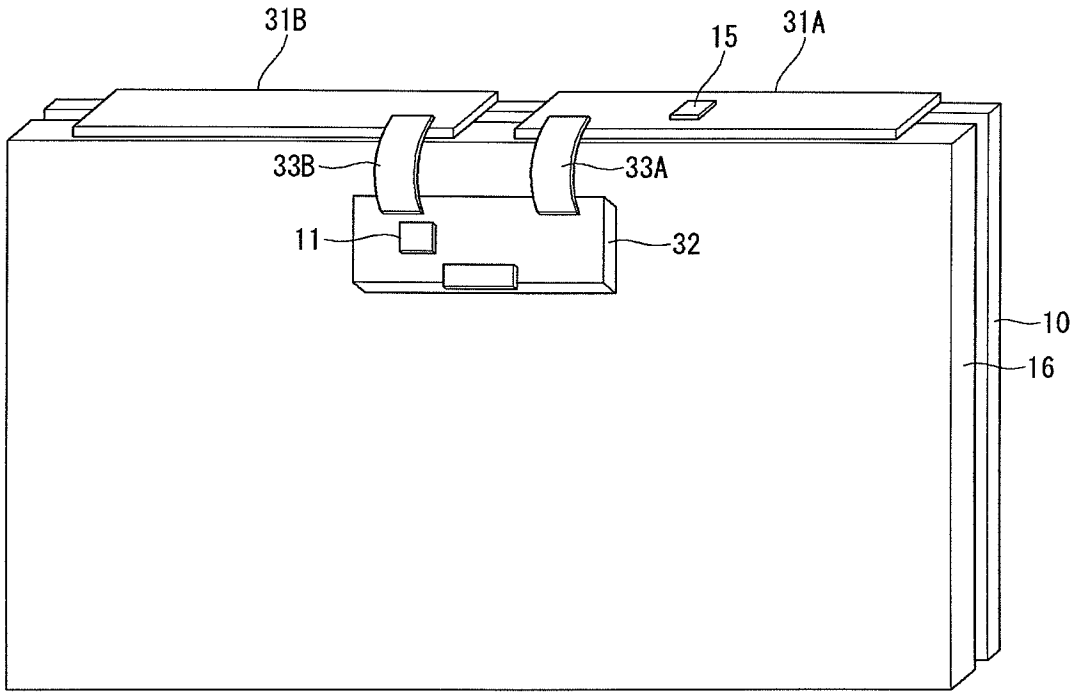
FIG. 4 is a rear perspective view of the liquid crystal module of FIG. 3.

FIGS. 3 and 4 illustrate an assembly state of a liquid crystal module according to a first embodiment of the invention. The liquid crystal module according to the first embodiment of the invention may have a circuit configuration illustrated in FIG. 1.

As shown in FIGS. 3 and 4, the liquid crystal module according to the first embodiment of the invention includes two source PCBs 31A and 31B, a control PCB 32, and first and second flexible circuit boards 33A and 33B connecting each of the source PCBs 31A and 31B to the control PCB 32. In the embodiment, two or more source PCBs may be used.

As a resolution and the size of the liquid crystal display increase, the size of the liquid crystal display panel 10 increases. An increase in the size of the liquid crystal display panel 10 causes an increase in the number of data lines and the number of source driver ICs in the pixel array. As a result, the size of the source PCB increases. Thus, when the size of the source PCB increases, the source PCB may be divided as shown in FIGS. 3 and 4 to the extent that the source PCB can be processed in an automatic mount device like surface mount technology (SMT) equipment.

Lines for cascade-connecting the source driver ICs of the data drive circuit 12 to one another are formed on each of the divided first and second source PCBs 31A and 31B, and each of the first and second source PCBs 31A and 31B has a relatively enough mounting space. All the circuit configurations or the partial circuit configuration of the DC to DC converter 15 are/is mounted in the mounting space of one of the first and second source PCBs 31A and 31B. Source driver ICs of a first group connected to the first source PCB 31A supply the data voltage to data lines positioned on one half on the left of the entire screen of the liquid crystal display panel 10. Source driver ICs of a second group connected to the second source PCB 31B supply the data voltage to data lines positioned on one half on the right of the entire screen of the liquid crystal display panel 10.

The timing controller 11, a memory such as electrically erasable programmable read-only memory (EEPROM), and the like may be mounted on the control PCB 32, and also the partial circuit configuration of the DC to DC converter 15 may be additionally mounted on the control PCB 32. Because at least a portion of the circuit configurations of the DC to DC converter 15 is mounted in the mounting space of one of the first and second source PCBs 31A and 31B, the size of the control PCB 32 may be reduced. For example, FIGS. 3 and 4 show the DC to DC converter 15 mounted on the first source PCB 31A.

One terminal of the first flexible circuit board 33A is connected to the first source PCB 31A through a first connector on the first source PCB 31A, and the other terminal is connected to the control PCB 32 through a first connector on the control PCB 32. A plurality of signal lines transferring the R, G, and B digital video data, the data control signals SSP, SSC, SOE, POL, etc. and the gate control signals GSP, GSC, GOE, etc. from the timing controller 11 and a power line transferring the input voltage Vin generated by the power circuit of the system board 14 are formed on the first flexible circuit board 33A. The R, G, and B digital video data, the data control signals SSP, SSC, SOE, POL, etc. and the gate control signals GSP, GSC, GOE, etc. are supplied to each of the source driver ICs connected to the first source PCB 31A. The gate control signals GSP, GSC, GOE, etc. are transferred to each of the gate driver ICs through lines separately formed on a tape carrier package (TCP), on which one of the source driver ICs connected to the first source PCB 31A is mounted, or through a separate flexible circuit board. The input voltage Vin is supplied to the DC to DC converter 15 on the first source PCB 31A through the first flexible circuit board 33A. Lines for transferring a carry signal, that is generated from a last source driver IC performing a final sampling operation of the R, G, and B digital video data among the source driver ICs connected to the first source PCB 31A, are further formed on the first flexible circuit board 33A.

One terminal of the second flexible circuit board 33B is connected to the second source PCB 31B through a first connector on the second source PCB 31B, and the other terminal is connected to the control PCB 32 through a second connector on the control PCB 32. A plurality of signal lines transferring the R, G, and B digital video data and the data control signals SSP, SSC, SOE, POL, etc. from the timing controller 11 are formed on the second flexible circuit board 33B. The R, G, and B digital video data and the data control signals SSP, SSC, SOE, POL, etc. are supplied to each of the source driver ICs connected to the second source PCB 31B. Carry signal transferring lines are further formed on the second flexible circuit board 33B. The carry signal transferring lines are used to transfer the carry signal transferred through the first source PCB 31A, the first flexible circuit board 33A, and the control PCB 32 to a first source driver IC performing a first sampling operation of the R, G, and B digital video data among the source driver ICs connected to the second source PCB 31B.

The first and second flexible circuit boards 33A and 33B may be implemented as one of a flexible printed circuit board (FPCB) and a flexible flat cable (FFC). In the module assembly process, the first and second flexible circuit boards 33A and 33B are bent. Hence, the first and second source PCBs 31A and 31B may be positioned opposite the side of the liquid crystal module (i.e., the side of the top case), and the control PCB 32 may be positioned in the rear of the liquid crystal module (i.e., in the rear of the bottom cover).

FIGS. 3 and 4 show the source PCBs 31A and 31B connected to an upper end of the liquid crystal module. However, other structures of the source PCBs 31A and 31B may be used. For example, the source PCBs 31A and 31B may be connected to a lower end of the liquid crystal module. Further, in case of a liquid crystal display having a structure in which data lines are arranged in a direction of the gate lines of FIG. 1 and gate lines are arranged in a direction of the data lines of FIG. 1, the source PCBs 31A and 31B may be connected to a left end and/or a right end of the liquid crystal module.

Figure 5:
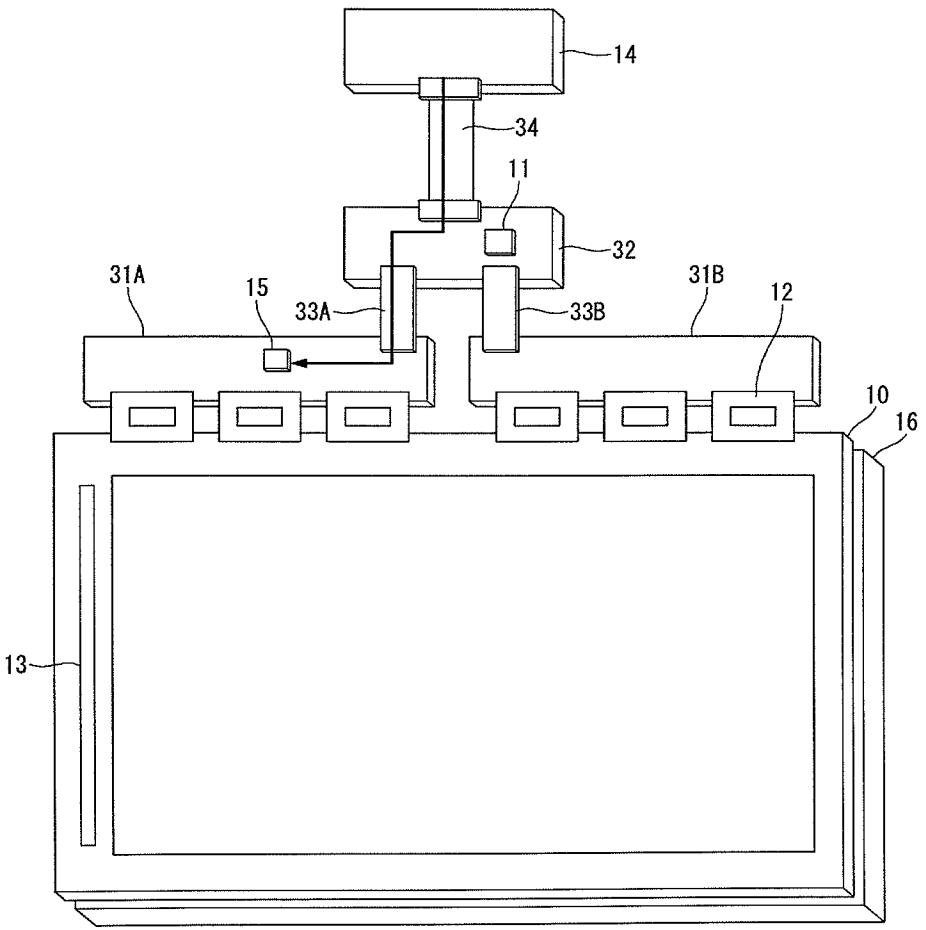
FIG. 5 is a perspective view illustrating a first example of a power supply path of a DC to DC converter mounted on a source printed circuit board (PCB) in the liquid crystal module of FIG. 3.
Figure 6:
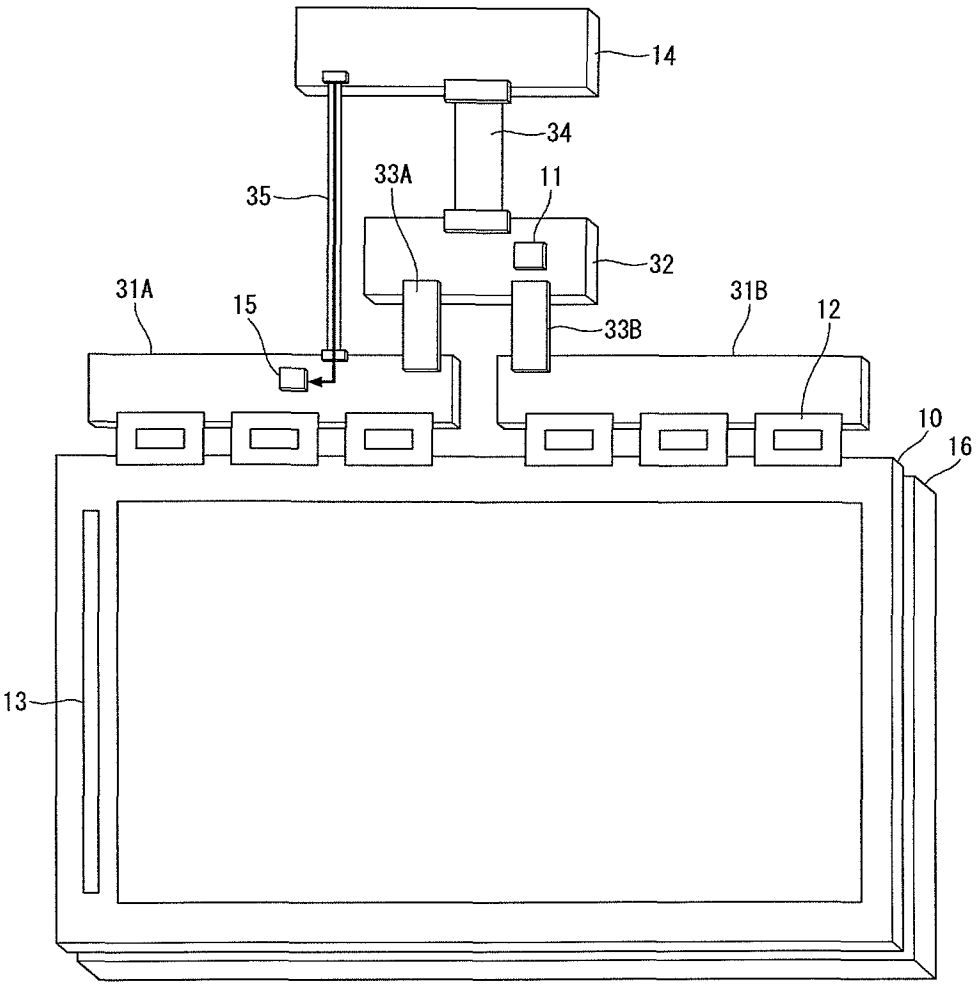
FIG. 6 is a perspective view illustrating a second example of a power supply path of a DC to DC converter mounted on a source PCB in the liquid crystal module of FIG. 3.

The input voltage Vin may be supplied to the DC to DC converter 15 on the first source PCB 31A along a power supply path indicated by the arrow in FIGS. 5 and 6.

More specifically, as shown in FIG. 5, a reference numeral '34' indicates a third flexible circuit board connecting the control PCB 32 to the system board 14 through a third connector on the control PCB 32 and a first connector on the system board 14. The system board 14 transfers the input voltage Vin of the DC to DC converter 15, R, G, and B digital video data of LVDS or TMDS interface standard, and the timing signals Vsync, Hsync, DE, and CLK to the control PCB 32 through the third flexible circuit board 34. Accordingly, the DC to DC converter 15 on the first source PCB 31A can receive the input voltage Vin from the system board 14 through the power circuit of the system board 14, the third flexible circuit board 34, the control PCB 32, the first flexible circuit board 33A, and the first source PCB 31A.

Further, as shown in FIG. 6, a reference numeral '35' indicates a fourth flexible circuit board forming a power supply path between the first source PCB 31A and the system board 14 through a second connector on the first source PCB 31A and a second connector on the system board 14. The system board 14 directly supplies the input voltage Vin of the DC to DC converter 15 to the first source PCB 31A through the fourth flexible circuit board 35 and transfers the R, G, and B digital video data of LVDS or TMDS interface standard and the timing signals Vsync, Hsync, DE, and CLK to the control PCB 32 through the third flexible circuit board 34. Accordingly, the DC to DC converter 15 on the first source PCB 31A can directly receive the input voltage Vin from the system board 14 through the power circuit of the system board 14, the fourth flexible circuit board 35, and the first source PCB 31A.

In the liquid crystal display according to the embodiment of the invention, because at least a portion of the circuit configurations of the DC to DC converter 15 is mounted on one of the first and second source PCBs 31A and 31B, the size of the control PCB 32 can decrease. Further, the system board 14 and the control PCB 32 shown in FIGS. 3 to 6 may be implemented as one system integrated board as shown in FIGS. 7 and 8.

Figure 7:
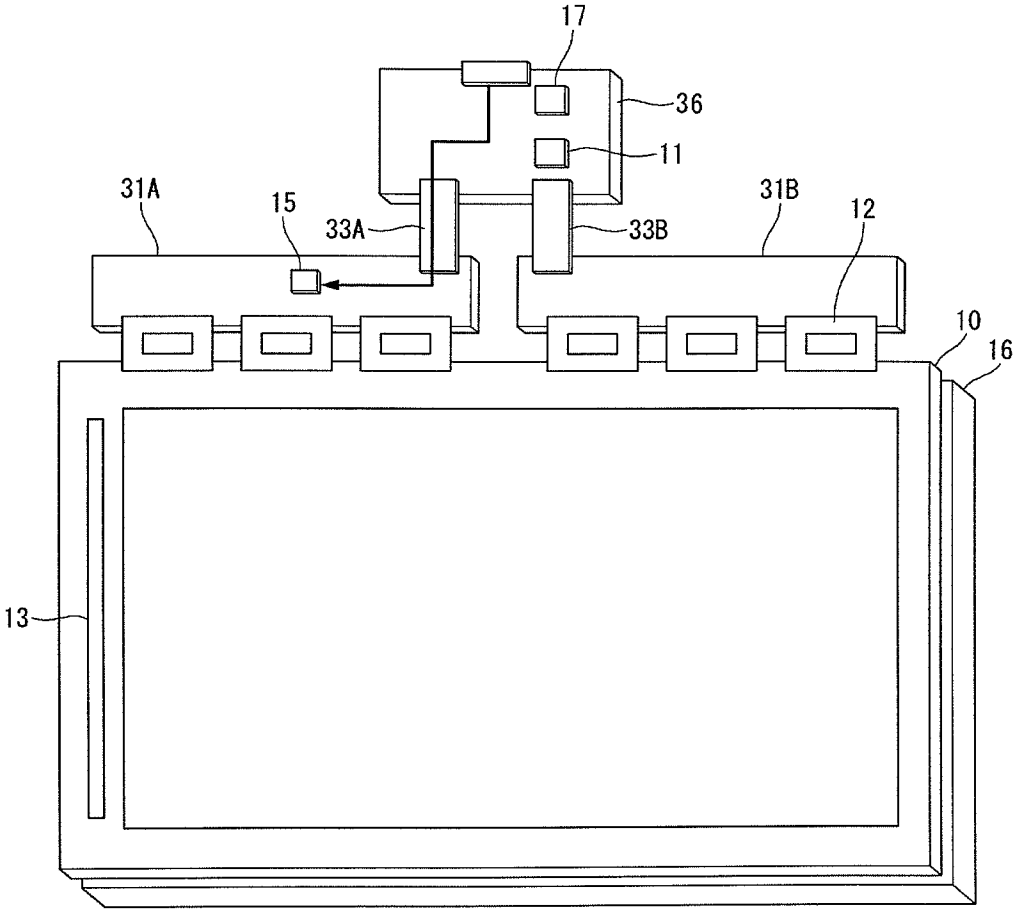
FIG. 7 is a perspective view illustrating a first example of a power supply path of a DC to DC converter mounted on a source PCB in a liquid crystal module according to a second embodiment of the invention.
Figure 8:
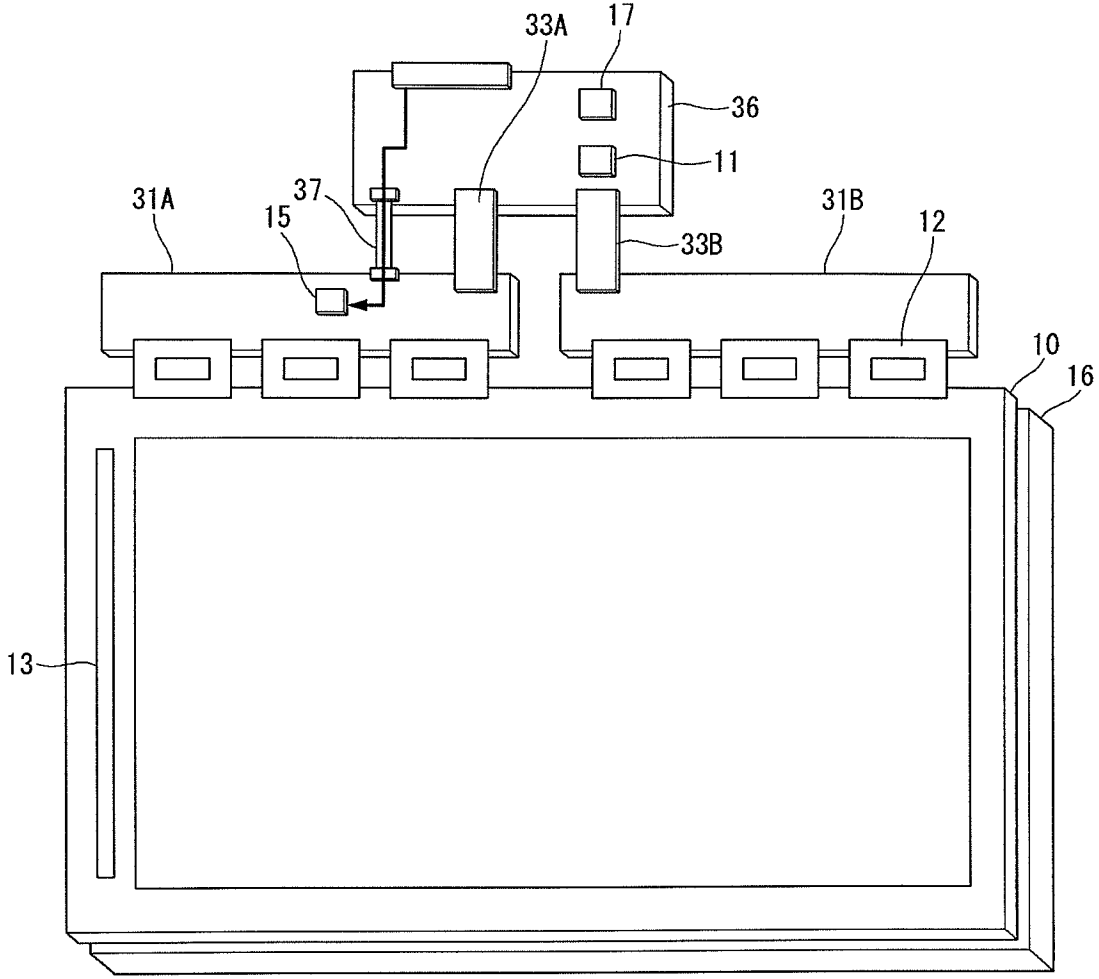
FIG. 8 is a perspective view illustrating a second example of a power supply path of a DC to DC converter mounted on a source PCB in the liquid crystal module of FIG. 7.

FIGS. 7 and 8 illustrate an assembly state of a liquid crystal module according to a second embodiment of the invention. The liquid crystal module according to the second embodiment of the invention may have the circuit configuration illustrated in FIG. 1.

As shown in FIGS. 7 and 8, the liquid crystal module according to the second embodiment of the invention includes two source PCBs 31A and 31B, a system integrated board 36, and first and second flexible circuit boards 33A and 33B connecting each of the source PCBs 31A and 31B to the system integrated board 36. In the embodiment, two or more source PCBs may be used.

The timing controller 11, a memory, a graphic processing circuit 17, a power circuit, etc. are mounted on the system integrated board 36. The graphic processing circuit 17 includes a signal interpolation circuit, a scaler circuit, etc. At least a portion of the circuit configurations of the DC to DC converter 15 may be mounted on the first source PCB 31A, and the other circuit configurations may be mounted on the system integrated board 36.

One terminal of the first flexible circuit board 33A is connected to the first source PCB 31A through a first connector on the first source PCB 31A, and the other terminal is connected to the system integrated board 36 through a first connector on the system integrated board 36. A plurality of signal lines transferring the R, G, and B digital video data, the data control signals SSP, SSC, SOE, POL, etc. and the gate control signals GSP, GSC, GOE, etc. from the timing controller 11 and a power line transferring an input voltage Vin generated by the power circuit are formed on the first flexible circuit board 33A. The R, G, and B digital video data, the data control signals SSP, SSC, SOE, POL, etc. and the gate control signals GSP, GSC, GOE, etc. are supplied to each of the source driver ICs connected to the first source PCB 31A. The gate control signals GSP, GSC, GOE, etc. are transferred to each of the gate driver ICs through lines separately formed on a tape carrier package (TCP), on which one of the source driver ICs connected to the first source PCB 31A is mounted, or through a separate flexible circuit board. The input voltage Vin is supplied to the DC to DC converter 15 on the first source PCB 31A through the first flexible circuit board 33A. Lines for transferring a carry signal, that is generated from a last source driver IC performing a final sampling operation of the R, G, and B digital video data among the source driver ICs connected to the first source PCB 31A, are further formed on the first flexible circuit board 33A.

One terminal of the second flexible circuit board 33B is connected to the second source PCB 31B through a first connector on the second source PCB 31B, and the other terminal is connected to the system integrated board 36 through a second connector on the system integrated board 36. A plurality of signal lines transferring the R, G, and B digital video data and the data control signals SSP, SSC, SOE, POL, etc. from the timing controller 11 are formed on the second flexible circuit board 33B. The R, G, and B digital video data and the data control signals SSP, SSC, SOE, POL, etc. are supplied to each of the source driver ICs connected to the second source PCB 31B. Carry signal transferring lines are further formed on the second flexible circuit board 33B. The carry signal transferring lines are used to transfer the carry signal transferred through the first source PCB 31A, the first flexible circuit board 33A, and the system integrated board 36 to a first source driver IC performing a first sampling operation of the R, G, and B digital video data among the source driver ICs connected to the second source PCB 31B.

FIGS. 7 and 8 show the source PCBs 31A and 31B connected to an upper end of the liquid crystal module. However, other structures of the source PCBs 31A and 31B may be used. For example, the source PCBs 31A and 31B may be connected to a lower end of the liquid crystal module. Further, in case of a liquid crystal display having a structure in which data lines are arranged in a direction of the gate lines of FIG. 1 and gate lines are arranged in a direction of the data lines of FIG. 1, the source PCBs 31A and 31B may be connected to a left end and/or a right end of the liquid crystal module.

As shown in FIG. 7, the DC to DC converter 15 mounted on the first source PCB 31A may receive the input voltage Vin from the system integrated board 36 through the power circuit mounted on the system integrated board 36 or an external power circuit, the first flexible circuit board 33A, and the first source PCB 31A. As shown in FIG. 8, the DC to DC converter 15 mounted on the first source PCB 31A may receive the input voltage Vin from the system integrated board 36 through the power circuit mounted on the system integrated board 36 or an external power circuit, a fifth flexible circuit board 37, and the first source PCB 31A. The fifth flexible circuit board 37 forms a power supply path between the first source PCB 31A and the system integrated board 36 through a second connector on the first source PCB 31A and a third connector on the system integrated board 36.

FIGS. 9 to 14 illustrate various embodiments of a liquid crystal module including a source PCB that is not divided.

Figure 9:
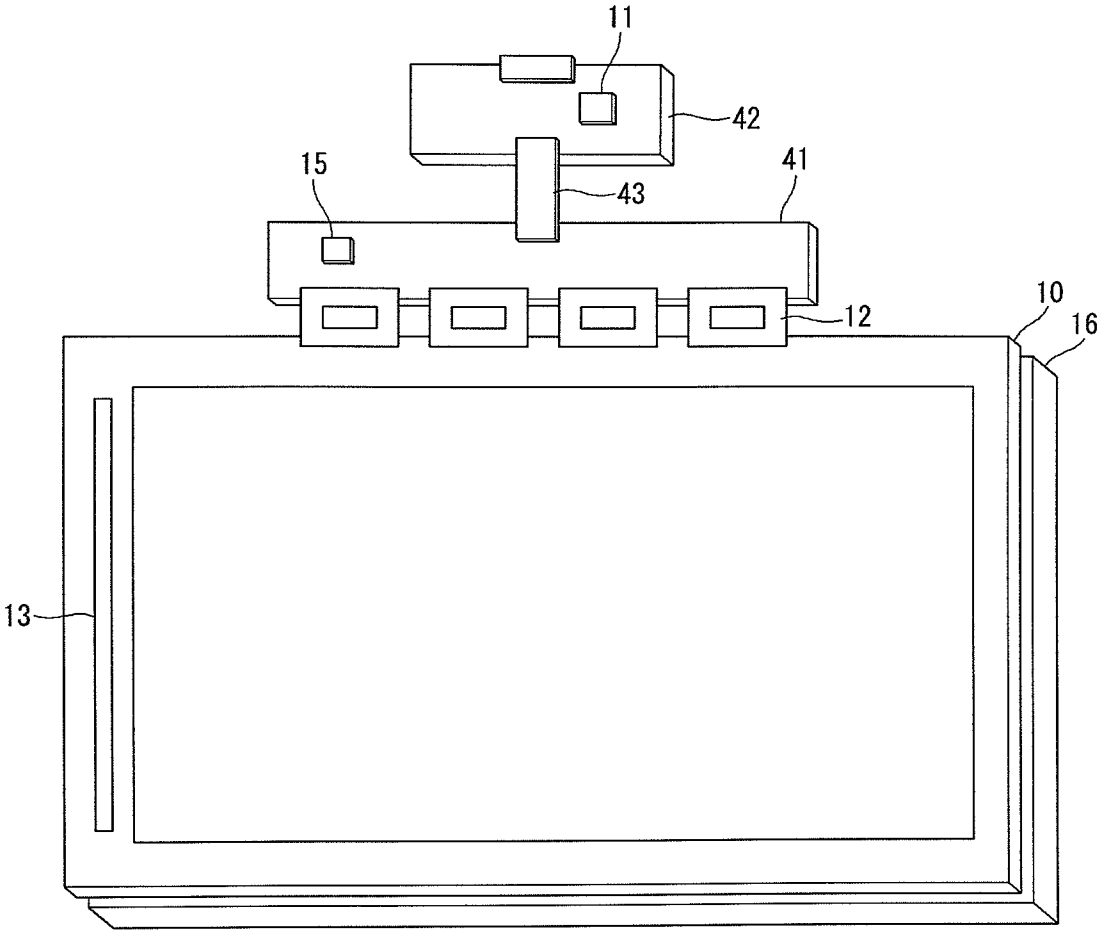
FIG. 9 is a front perspective view of a liquid crystal module according to a third embodiment of the invention.
Figure 10:
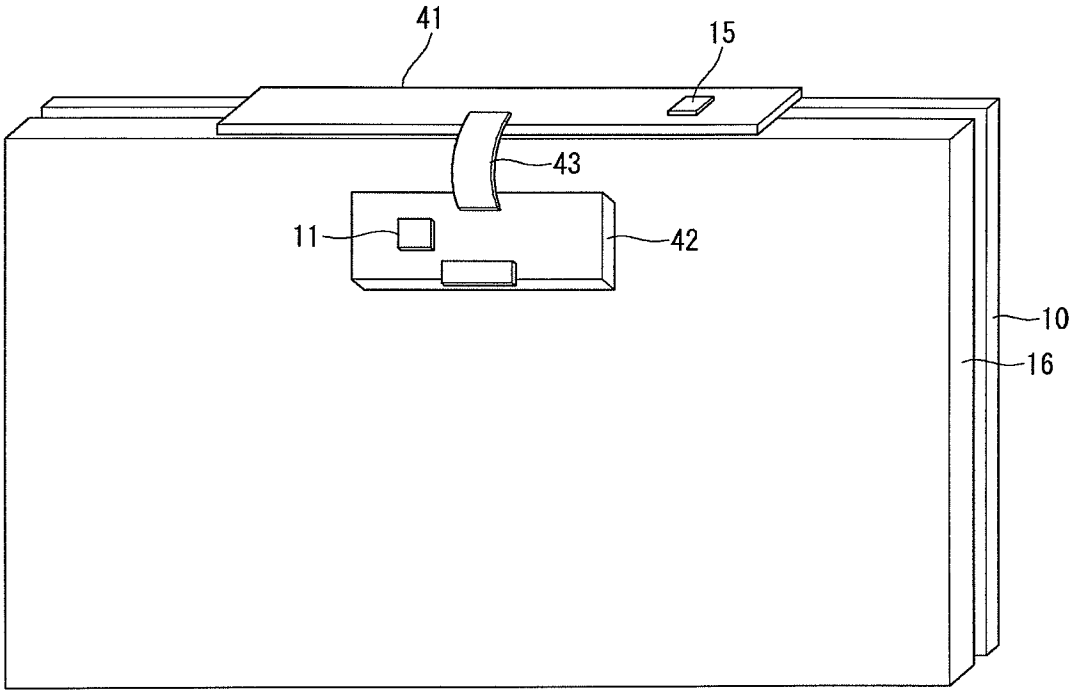
FIG. 10 is a rear perspective view of the liquid crystal module of FIG. 9.

FIGS. 9 and 10 illustrate an assembly state of a liquid crystal module according to a third embodiment of the invention. The liquid crystal module according to the third embodiment of the invention may have the circuit configuration illustrated in FIG. 1.

As shown in FIGS. 9 and 10, the liquid crystal module according to the third embodiment of the invention includes a source PCB 41, a control PCB 42, and a flexible circuit board 43 connecting the source PCB 41 to the control PCB 42.

All of circuit configurations or a partial circuit configuration of the DC to DC converter 15 are/is mounted in a mounting space of the source PCB 41. The source PCB 41 may be connected to an upper end or a lower end of the liquid crystal module. Further, the source PCB 41 may be connected to a left end or a right end of the liquid crystal module.

The timing controller 11, a memory such as EEPROM, and the like may be mounted on the control PCB 42, and also the partial circuit configuration of the DC to DC converter 15 may be additionally mounted on the control PCB 42. Because at least a portion of the circuit configurations of the DC to DC converter 15 is mounted in the mounting space of the source PCB 41, the size of the control PCB 42 may be reduced.

One terminal of the flexible circuit board 43 is connected to the source PCB 41 through a first connector on the source PCB 41, and the other terminal is connected to the control PCB 42 through a first connector on the control PCB 42. A plurality of signal lines transferring the R, G, and B digital video data, the data control signals SSP, SSC, SOE, POL, etc. and the gate control signals GSP, GSC, GOE, etc. from the timing controller 11 and a power line transferring the input voltage Vin generated by the power circuit of the system board 14 are formed on the flexible circuit board 43. The R, G, and B digital video data, the data control signals SSP, SSC, SOE, POL, etc. and the gate control signals GSP, GSC, GOE, etc. are supplied to each of the source driver ICs connected to the source PCB 41. The gate control signals GSP, GSC, GOE, etc. are transferred to each of the gate driver ICs through lines separately formed on a TCP, on which one of the source driver ICs connected to the source PCB 41 is mounted, or through a separate flexible circuit board. The input voltage Vin is supplied to the DC to DC converter 15 on the source PCB 41 through the flexible circuit board 43.

The flexible circuit board 43 may be implemented as one of a flexible printed circuit board (FPCB) and a flexible flat cable (FFC). In the module assembly process, the flexible circuit board 43 is bent. Hence, the source PCB 41 may be positioned opposite the side of the liquid crystal module (i.e., the side of the top case), and the control PCB 42 may be positioned in the rear of the liquid crystal module (i.e., in the rear of the bottom cover).

Figure 11:
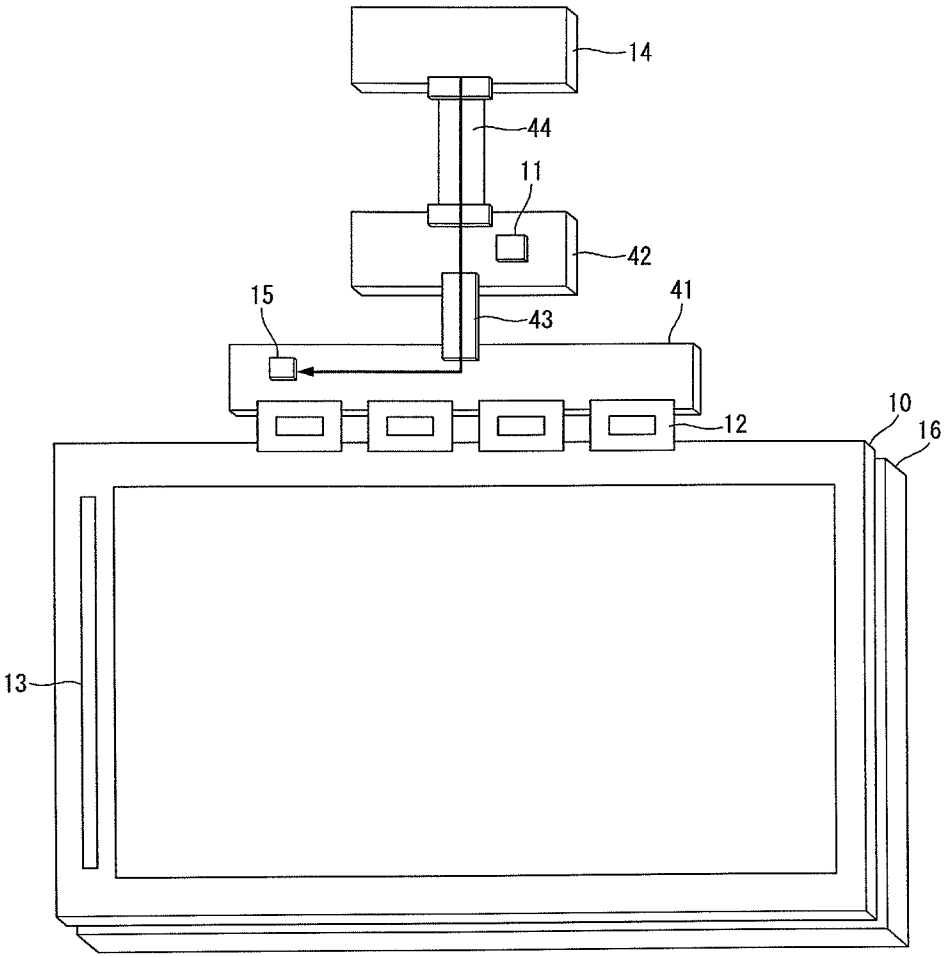
FIG. 11 is a perspective view illustrating a first example of a power supply path of a DC to DC converter mounted on a source PCB in the liquid crystal module of FIG. 9.

As shown in FIG. 11, the DC to DC converter 15 mounted on the source PCB 41 may receive the input voltage Vin from the system board 14 through the power circuit of the system board 14 or an external power circuit, another flexible circuit board 44, the control PCB 42, the flexible circuit board 43, and the source PCB 41. The flexible circuit board 44 connects the control PCB 42 to the system board 14 through a second connector on the control PCB 42 and a first connector on the system board 14.

Figure 12:
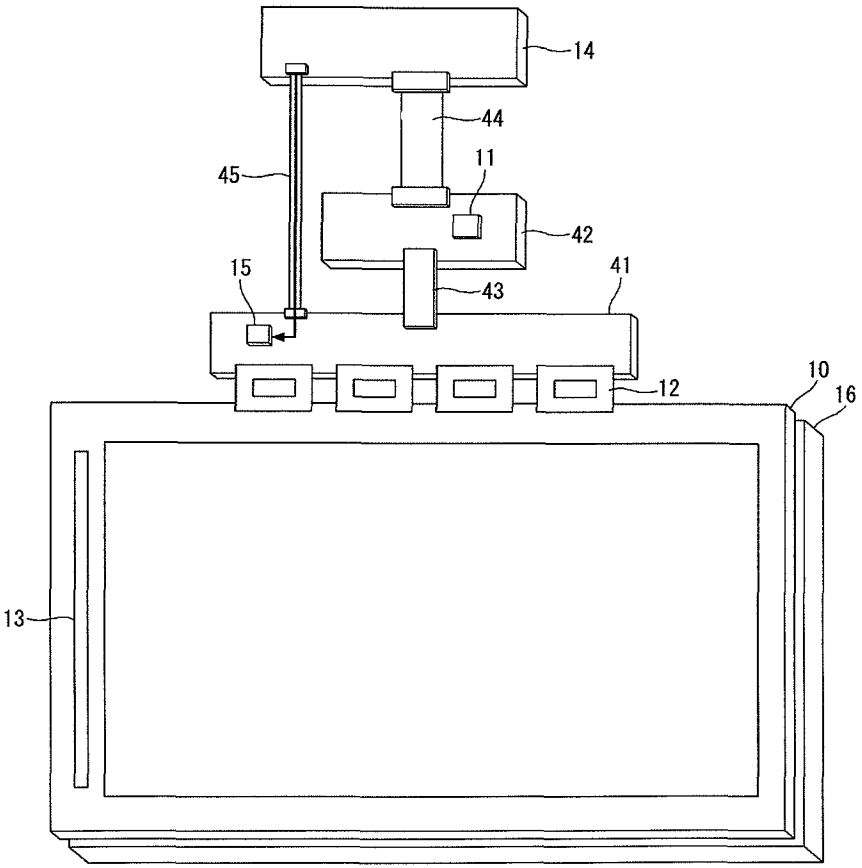
FIG. 12 is a perspective view illustrating a second example of a power supply path of a DC to DC converter mounted on a source PCB in the liquid crystal module of FIG. 9.

As shown in FIG. 12, the DC to DC converter 15 mounted on the source PCB 41 may directly receive the input voltage Vin from the system board 14 through the power circuit of the system board 14 or an external power circuit, another flexible circuit board 45, and the source PCB 41. The flexible circuit board 45 forms a power supply path between the source PCB 41 and the system board 14 through a second connector on the source PCB 41 and a second connector on the system board 14.

Figure 13:
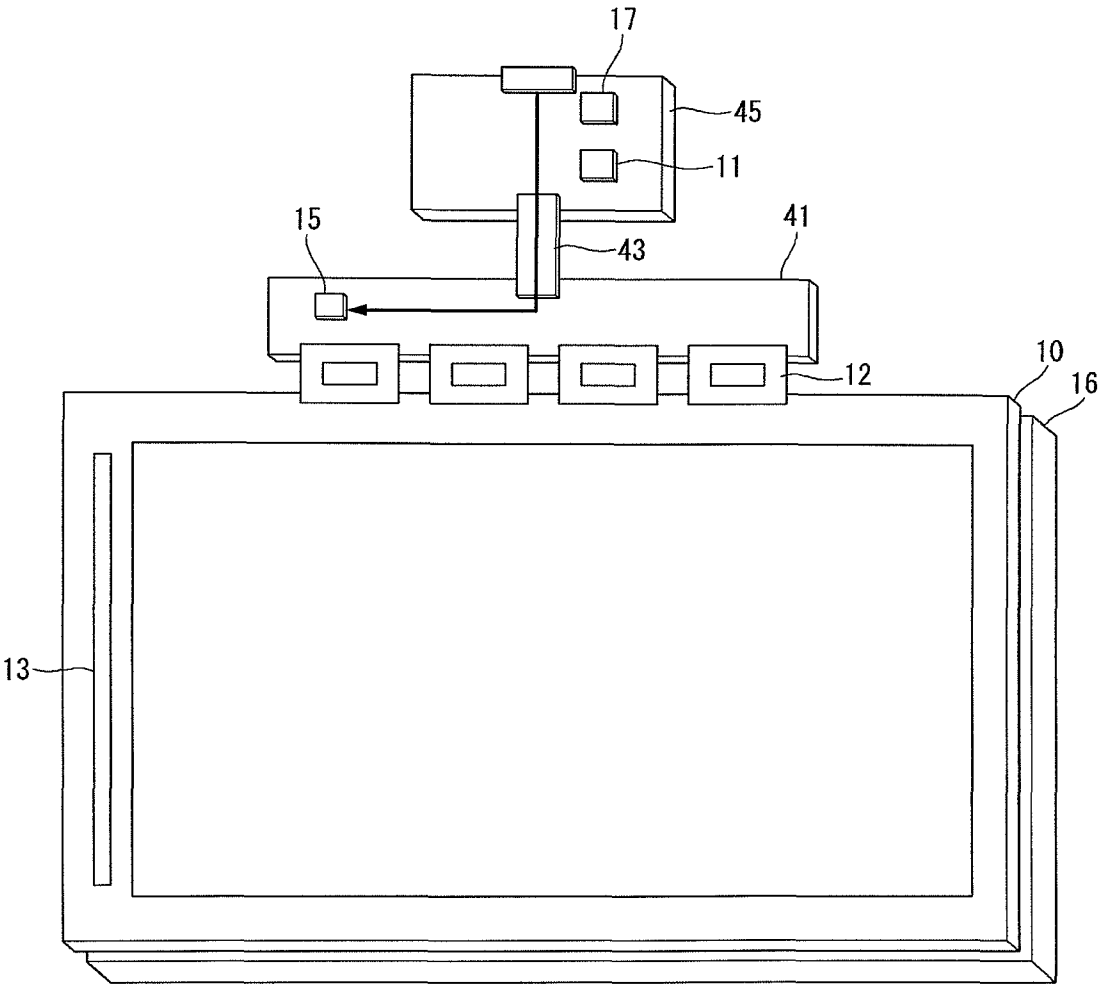
FIG. 13 is a perspective view illustrating a first example of a power supply path of a DC to DC converter mounted on a source PCB in a liquid crystal module according to a fourth embodiment of the invention.
Figure 14:
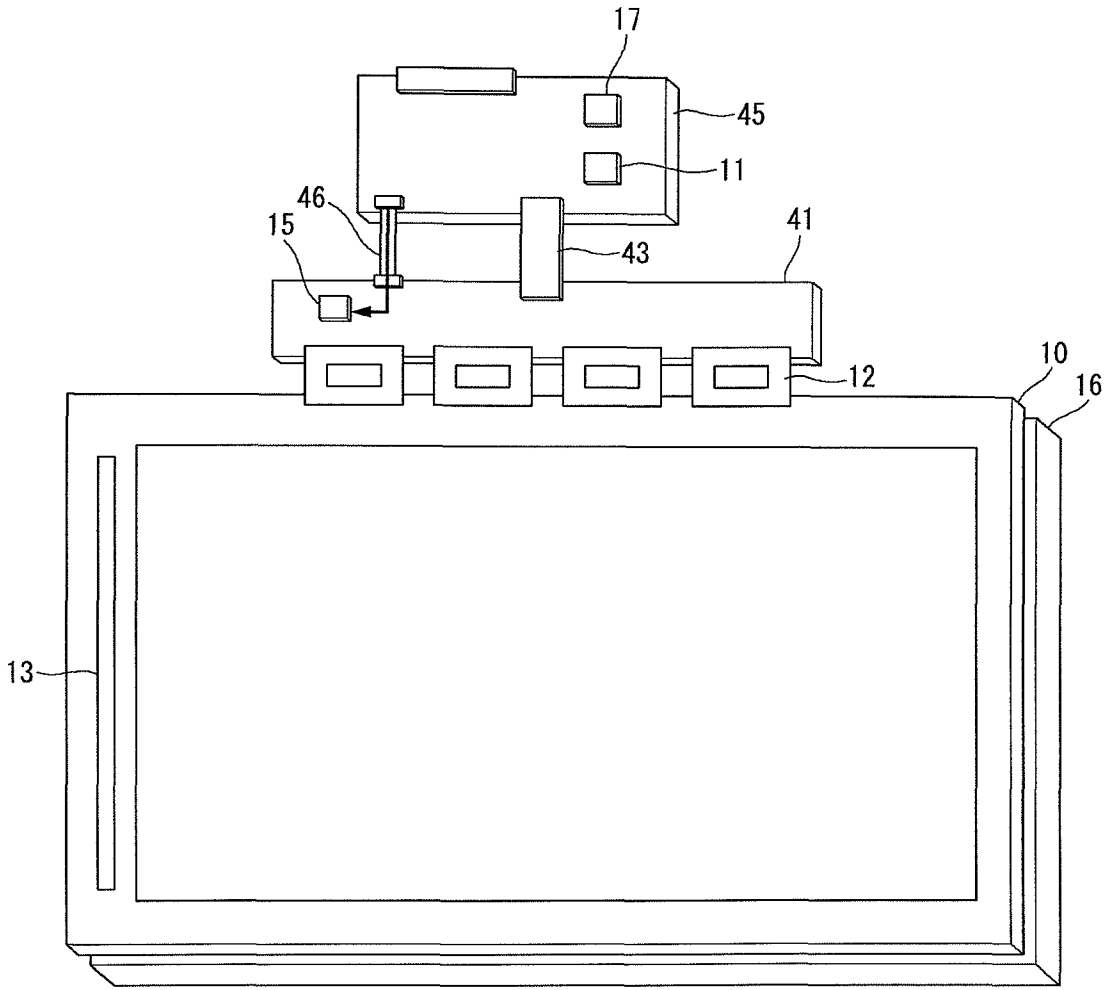
FIG. 14 is a perspective view illustrating a second example of a power supply path of a DC to DC converter mounted on a source PCB in the liquid crystal module of FIG. 13.

The system board 14 and the control PCB 42 shown in FIGS. 9 to 12 may be implemented as one system integrated board as shown in FIGS. 13 and 14.

FIGS. 13 and 14 illustrate an assembly state of a liquid crystal module according to a fourth embodiment of the invention. The liquid crystal module according to the fourth embodiment of the invention may have the circuit configuration illustrated in FIG. 1.

As shown in FIGS. 13 and 14, the liquid crystal module according to the fourth embodiment of the invention includes a source PCB 41, a system integrated board 45, and a flexible circuit board 43 connecting the source PCB 41 to the system integrated board 45.

The timing controller 11, a memory, a graphic processing circuit 17, a power circuit, etc. are mounted on the system integrated board 45. The graphic processing circuit 17 includes a signal interpolation circuit, a scaler circuit, etc. At least a portion of the circuit configurations of the DC to DC converter 15 may be mounted on the source PCB 41, and the other circuit configurations may be mounted on the system integrated board 45.

One terminal of the flexible circuit board 43 is connected to the source PCB 41 through a first connector on the source PCB 41, and the other terminal is connected to the system integrated board 45 through a first connector on the system integrated board 45. A plurality of signal lines transferring the R, G, and B digital video data, the data control signals SSP, SSC, SOE, POL, etc. and the gate control signals GSP, GSC, GOE, etc. from the timing controller 11 and a power line transferring an input voltage Vin generated by the power circuit are formed on the flexible circuit board 43. The R, G, and B digital video data, the data control signals SSP, SSC, SOE, POL, etc. and the gate control signals GSP, GSC, GOE, etc. are supplied to each of the source driver ICs connected to the source PCB 41. The gate control signals GSP, GSC, GOE, etc. are transferred to each of the gate driver ICs through lines separately formed on a TCP, on which one of the source driver ICs connected to the source PCB 41 is mounted, or through a separate flexible circuit board. The input voltage Vin is supplied to the DC to DC converter 15 on the source PCB 41 through the flexible circuit board 43.

As shown in FIG. 13, the DC to DC converter 15 mounted on the source PCB 41 may receive the input voltage Vin from the system integrated board 45 through the power circuit mounted on the system integrated board 45 or an external power circuit, the flexible circuit board 43, and the source PCB 41. As shown in FIG. 14, the DC to DC converter 15 mounted on the source PCB 41 may directly receive the input voltage Vin from the system integrated board 45 through the power circuit mounted on the system integrated board 45 or an external power circuit, another flexible circuit board 46, and the source PCB 41. The flexible circuit board 46 forms a power supply path between the source PCB 41 and the system integrated board 45 through a second connector on the source PCB 41 and a second connector on the system integrated board 45.

Figure 15:
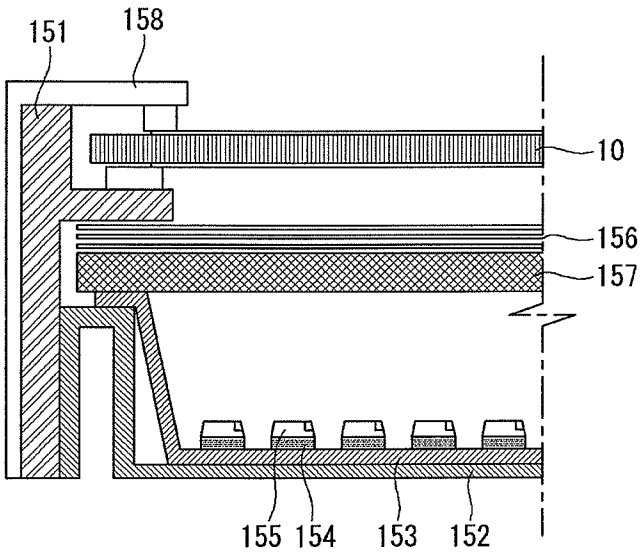
FIGS. 15 to 17 are cross-sectional views of a liquid crystal module according to an embodiment of the invention.
Figure 16:
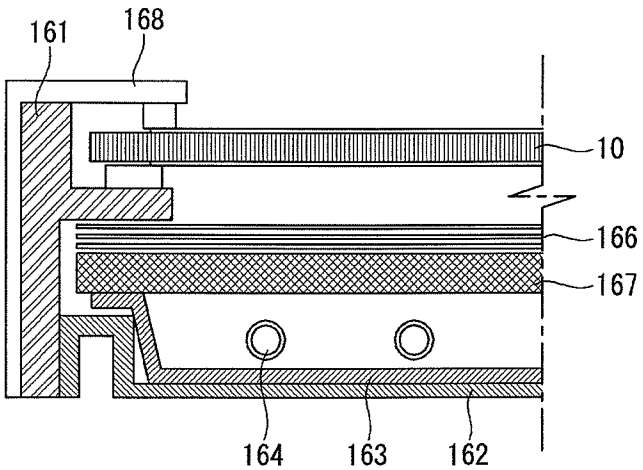
Figure 17:
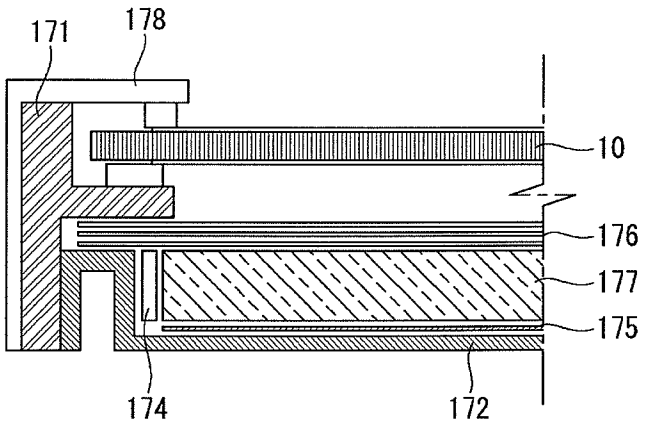

FIGS. 15 to 17 are longitudinal cross-sectional views showing a portion of an edge of the liquid crystal module according to the embodiments of the invention.

FIG. 15 illustrates a liquid crystal module including a direct type backlight unit using a LED as a light source. FIG. 16 illustrates a liquid crystal module including a direct type backlight unit using a CCFL as a light source.

As shown in FIG. 15, the liquid crystal module according to the embodiments of the invention includes a diffusion plate 157 stacked between the liquid crystal display panel 10 and LED packages 155 and a plurality of optical sheets 156. The optical sheets 156 include at least one prism sheet, at least one diffusion sheet, etc. to diffuse light coming from the diffusion plate 157 and to refract a travelling path of light substantially at a right angle to a light incident surface of the liquid crystal display panel 10. The optical sheets 156 may further include a dual brightness enhancement film (DBEF). The liquid crystal module includes guide and case members, such as a guide panel 151, a bottom cover 152, and a top case 158, for fixing the liquid crystal display panel 10 and the direct type backlight unit. Metal PCBs 154, on which the LED packages 155 are mounted, and a reflective sheet 153 are positioned on the bottom cover 152.

As shown in FIG. 16, the liquid crystal module according to the embodiments of the invention includes a diffusion plate 167 stacked between the liquid crystal display panel 10 and CCFLs 164 and a plurality of optical sheets 166. The liquid crystal module includes guide and case members, such as a guide panel 161, a bottom cover 162, and a top case 168, for fixing the liquid crystal display panel 10 and the direct type backlight unit. The CCRLs 164 and a reflective sheet 163 are positioned on the bottom cover 162.

FIG. 17 illustrates a liquid crystal module including an edge type backlight unit using a LED package as a light source.

As shown in FIG. 17, the liquid crystal module according to the embodiments of the invention includes LED packages 174 providing light to the side of a light guide plate 177 and a plurality of optical sheets 176 between the light guide plate 177 and the liquid crystal display panel 10. The liquid crystal module includes guide and case members, such as a guide panel 171, a bottom cover 172, and a top case 178, for fixing the liquid crystal display panel 10 and the edge type backlight unit. A reflective sheet 175 opposite the light guide plate 177 is positioned on the bottom cover 172.

In the liquid crystal display according to the embodiments of the invention, the control PCB and the system integrated board are positioned in the rear of the bottom cover, so that the control PCB and the system integrated board can be folded in the rear of the liquid crystal module shown in FIGS. 15 to 17. The source PCB may be positioned at the side of the liquid crystal module, so that the source PCB is positioned opposite the side of the top case.

As described above, in the liquid crystal display according to the embodiments of the invention, the size of the control PCB can be reduced by mounting all of the circuit configurations or the partial circuit configuration of the DC to DC converter in the mounting space of the source PCB. Hence, the thin profile of the liquid crystal display can be achieved. Furthermore, the connection manner between the system board and the control PCB or between the system board and the source PCB may variously designed by mounting all of the circuit configurations or the partial circuit configuration of the DC to DC converter in the mounting space of the source PCB.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A liquid crystal display comprising:

a liquid crystal display panel having a plurality of data lines and a plurality of gate lines positioned to cross one another and a plurality of liquid crystal cells driven according to a voltage difference between a data voltage and a common voltage positioned in a matrix format;

a side printed circuit board (PCB) connected to the side of the liquid crystal display panel;

a DC to DC converter mounted on the side PCB to produce a driving voltage of the liquid crystal display panel;

a data drive circuit connected between the side PCB and the data lines of the liquid crystal display panel to convert digital video data into the data voltage using a gamma reference voltage and to supply the data voltage to the data lines;

a gate drive circuit connected to the gate lines of the liquid crystal display panel to sequentially supply a gate pulse swinging between a gate high voltage and a gate low voltage to the gate lines; and a timing controller that supplies the digital video data to the data drive circuit and controls an operating timing of the data drive circuit and an operating timing of the gate drive circuit, wherein the DC to DC converter includes at least one of a first voltage adjusting circuit converting an input voltage into a high potential power supply voltage of 15V-20V and a logic power supply voltage of about 3.3V, a second voltage adjustinq circuit converting the high potential power supply voltage into the gate high voltage equal to or greater than 15V and the gate low voltage equal to or less than −3V, a third voltage adjusting circuit converting the high potential power supply voltage into the common voltage of 7V-8V, a fourth voltage adjusting circuit dividing the high potential power supply voltage to generate the gamma reference voltage, and a fifth voltage adjusting circuit converting one of the input voltage and the logic power supply voltage into a core power voltage of 1.2V-1.8V to supply the core power voltage to the timing controller, wherein at least one of the first to fifth voltage adjusting circuits is mounted on the side PCB.

2. The liquid crystal display of claim 1, wherein the data drive circuit includes:

source driver integrated circuit (ICs) of a first group that supply the data voltage to data lines positioned in a first screen portion of the liquid crystal display panel; and source driver ICs of a second group that supply the data voltage to data lines positioned in a second screen portion of the liquid crystal display panel.

3. The liquid crystal display of claim 2, wherein the side PCB includes:

a first source PCB connected to the source driver ICs of the first group; and a second source PCB connected to the source driver ICs of the second group.

4. The liquid crystal display of claim 3, further comprising:

a control PCB on which the timing controller is mounted;

a first flexible circuit board connected between the first source PCB and the control PCB; and a second flexible circuit board connected between the second source PCB and the control PCB.

5. The liquid crystal display of claim 4, wherein the DC to DC converter is mounted on the first source PCB, wherein the first flexible circuit board transfers the digital video data input from the timing controller and a data control signal for controlling an operating timing of the source driver ICs of the first and second groups to the first source PCB and transfers a carry signal generated by one of the source driver ICs of the first group to the control PCB, wherein the second flexible circuit board transfers the digital video data input from the timing controller and the data control signal to the second source PCB and transfers the carry signal to one of the source driver ICs of the second group.

6. The liquid crystal display of claim 5, wherein the input voltage is supplied to the DC to DC converter through the first flexible circuit board.

7. The liquid crystal display of claim 5, further comprising a third flexible circuit board that is connected between the control PCB and the first source PCB to supply the input voltage to the DC to DC converter.

8. The liquid crystal display of claim 3, further comprising:

a system integrated board on which the timing controller and a graphic processing circuit are mounted, the graphic processing circuit performing a signal interpolation processing on the digital video data and adjusting a resolution of the digital video data to supply the adjusted digital video data to the timing controller;

a first flexible circuit board connected between the first source PCB and the system integrated board; and a second flexible circuit board connected between the second source PCB and the system integrated board, wherein the DC to DC converter is mounted on the first source PCB, wherein the first flexible circuit board transfers the digital video data input from the timing controller and a data control signal for controlling an operating timing of the source driver ICs of the first and second groups to the first source PCB and transfers a carry signal generated by one of the source driver ICs of the first group to the system integrated board, wherein the second flexible circuit board transfers the digital video data input from the timing controller and the data control signal to the second source PCB and transfers the carry signal to one of the source driver ICs of the second group.

9. The liquid crystal display of claim 8, wherein the input voltage is supplied to the DC to DC converter through the first flexible circuit board.

10. The liquid crystal display of claim 8, wherein further comprising a third flexible circuit board that is connected between the system integrated board and the first source PCB to supply the input voltage to the DC to DC converter.

* * * * *